US006168496B1

(12) United States Patent
Thomas

(10) Patent No.: US 6,168,496 B1
(45) Date of Patent: Jan. 2, 2001

(54) FABRIC-COVERED SPRING TOY AND METHOD FOR PRODUCING

(75) Inventor: Yip Wing Kay Thomas, Guang Dong (CN)

(73) Assignee: James Industries, Inc., Hollidaysburg, PA (US)

( * ) Notice: Under 35 U.S.C. 154(b), the term of this patent shall be extended for 0 days.

(21) Appl. No.: 09/318,977

(22) Filed: May 26, 1999

(51) Int. Cl.[7] ..... A13H 33/00; D05B 23/00
(52) U.S. Cl. ..... 446/486; 112/63
(58) Field of Search ..... 446/486, 369, 446/370, 371, 490, 385; 112/63, 470.33; 5/720

(56) References Cited

U.S. PATENT DOCUMENTS 1,270,840 * 7/1918 Kelly ..... 5/720
1,355,799 * 10/1920 Bradish ..... 446/370
1,551,250 * 8/1925 Henry ..... 446/370
3,410,023 * 11/1968 Anello ..... 466/486
3,448,539 * 6/1969 Hartpence ..... 446/370
3,557,436 1/1971 Hodes ..... 29/428
4,505,687 * 3/1985 Munro ..... 446/369
5,621,935 * 4/1997 St. Clair ..... 5/720

* cited by examiner

*Primary Examiner*—D. Neal Muir
(74) *Attorney, Agent, or Firm*—Howson and Howson

(57) ABSTRACT

A method is provided for producing a fabric-covered spring toy having a helical body which is decorated both on its outside and on its confronting helical surfaces. In the method, a fabric tube is everted using a lanyard to pull one end of the tube through the tube center to produce the fabric tube. Everting produces a tube with a decorative surface on the outer face. The resulting fabric covered spring body can be sewn to other fabric structures such as simulated animal body parts, for incorporation into an animal-like product having a semi-soft, flexible body.

8 Claims, 2 Drawing Sheets

FIG. 1
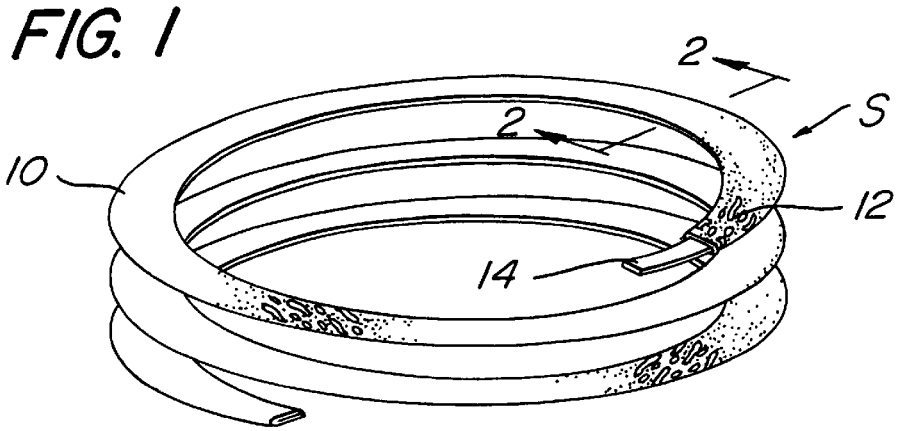
FIG. 2
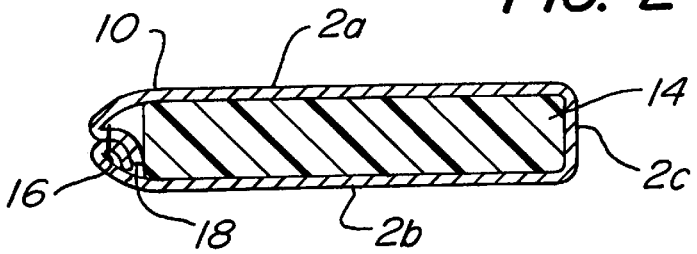
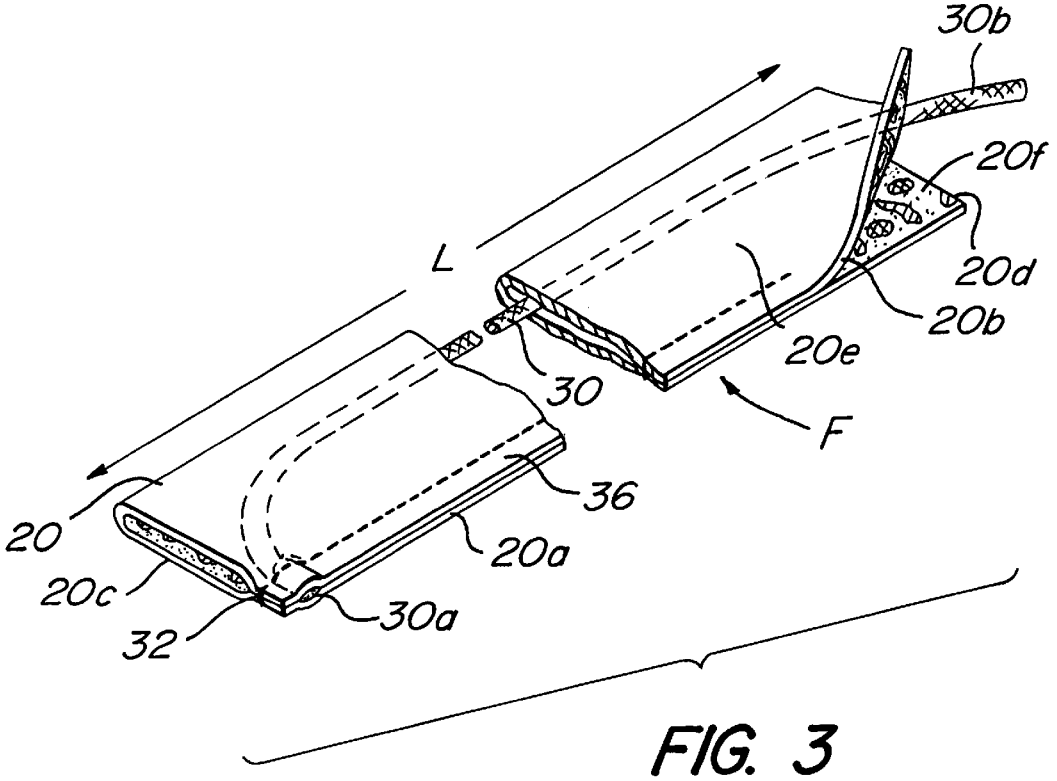
FIG. 3

FABRIC-COVERED SPRING TOY AND METHOD FOR PRODUCING

FIELD OF THE INVENTION

The present invention relates to a spring toy, and more particularly to a spring toy having a fabric covering.

BACKGROUND OF THE INVENTION

Slinky® is the registered trademark of a helical spring toy, first patented in 1947, that is manufactured by James Industries, Inc. The toy consisted, at its inception, solely of a flat wound helical coil of stock spring steel. Since then, there have been several modifications of the original design. Some of these modifications have included its use in pull toys, such as the recent movie-made-popular Slinky® Dog pull toy.

While the essential helical structure of the Slinky® spring toy has varied little over the years, the finish has changed. For instance, brass has been used to provide a bright finish, and even precious metals such as gold have adorned Slinky® coils. Plastic Slinky® spring toys have been developed that can be produced in many colors, including bi-color and so-called "neon" plastic materials.

Due to the simple nature of the Slinky® toy product, it is desirable to provide it with an alluring appearance, especially to children. In the past, the exterior surfaces of the coils have been printed with designs, but there has been no known method for applying complex decorations to the confronting surfaces of the coils. The present invention provides a unique method for applying a fabric covering to the coils of a Slinky® spring toy to provide a novel decorative effect on both the inside and outside edges of the coils as well as to provide a means for enabling opposite ends of the coils to be sewn to other fabric structures to provide an animal-like product having a semi-soft, flexible body.

OBJECTS OF THE INVENTION

A primary object of the invention is to provide a helical spring toy having a decorative fabric covering.

Another object of the invention is to provide a novel method for producing a decorative helical spring toy having decorations on both its outside edges and confronting coil surfaces.

A further object of the invention is to provide a simple method for producing a helical spring toy having a fabric covering with a concealed seam.

A still further object of the invention is to provide a simple method for attaching a spring toy to plush fabric structures for providing a novel product.

SUMMARY OF THE INVENTION

More specifically, the present invention provides a fabric-covered spring toy particularly suited for use in forming a flexible body portion of the toy product having a head and a tail, and to a method of producing such a fabric-covered spring toy. In the method, an elongate strip of cloth is provided having longitudinal edge margins and first and second end margins. The cloth has an in-side and a decorative out-side. The cloth strip is folded lengthwise with the out-side facing inward, and the longitudinal edge margins are sewn together forming an elongate tube. The tube is everted so the cloth decorative side faces outward. The everted cloth tube is then slid over a spring toy along its full helical length. The tube is then sewn at its end margins to fully enclose the helical body. This results in a fabric covered spring which can be further sewn to simulated animal body parts.

BRIEF DESCRIPTION OF THE DRAWINGS

The foregoing and other objects, features and advantages of the present invention should become apparent from the following description when taken in conjunction with the accompanying drawings in which:

FIG. 1 is a fragmentary perspective view of a portion of a fabric-covered spring toy with the spring core exposed;

FIG. 2 is a transverse cross-sectional view of the fabric-covered spring toy taken on line 2—2 of FIG. 3;

FIG. 3 is a foreshortened, partially broken away and sectional, perspective view of a strip of cloth folded lengthwise over a lanyard and with an upturned fabric region showing a decorative pattern;

DETAILED DESCRIPTION OF THE PREFERRED PROCESS AND PRODUCT

Figure 4:
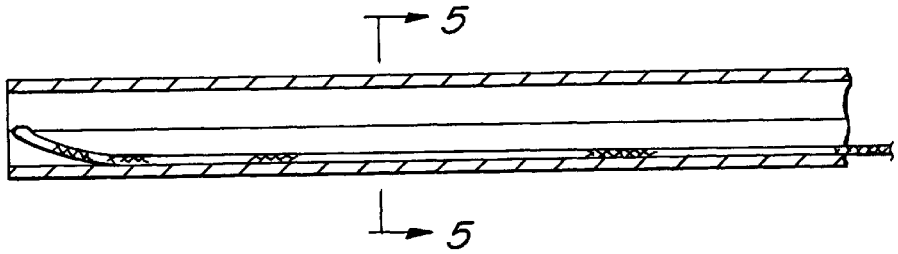
FIG. 4 is a fragmentary longitudinal sectional view of the fabric strip folded over the lanyard.

Referring now to the drawings, FIG. 1 illustrates a portion of a helical spring toy S having a fabric covering 10 with a decorative outside design 12. One end of the fabric covering 10 has been cut away to expose the spring body, or core 14, of conventional construction, such as of plastic. FIG. 2 illustrates the spring toy core 14 with the fabric covering 10 completely enveloping it and with a concealed inside seam 16 and flange 18. FIG. 2 illustrates the spring toy S with the inside seam 16 that is formed by the preferred process along with the two coil-confronting surfaces 2*a* & 2*b* and an outside edge 2*c*.

Initially, the process entails providing an elongate strip of cloth 20, for instance, by cutting a larger piece into smaller strips so that it has the preferred elongate shape with longitudinal edge margins 20*a* & 20*b*, first and second end margins, 20*c* and 20*d* respectively, end margins and an in-side 20*e* and an out-side 20*f*. Preferably, the cloth is of polyknit material, but may be woven and is preferably stretchable. A design or pattern may be printed on, or woven into, the outside 20*f* of the cloth 20 resulting in a decorative side preferred for display. After the tube is everted, the in-side of the tube will face inward and the out-side will face outward. The directions parallel to the longitudinal margins 20*a* & 20*b* will be herein referred to as longitudinal L (see FIG. 3)and the directions perpendicular to this will be referred to as transverse (see FIG. 3).

The next two steps, resulting in the intermediate product of FIG. 3, entail folding the elongate strip of cloth 20 lengthwise over a longitudinally extending lanyard, or string 30, bringing the longitudinal edge margins 20*a* & 20*b* into mutual contact, with the desired out-side decorative surface

Figure 5:
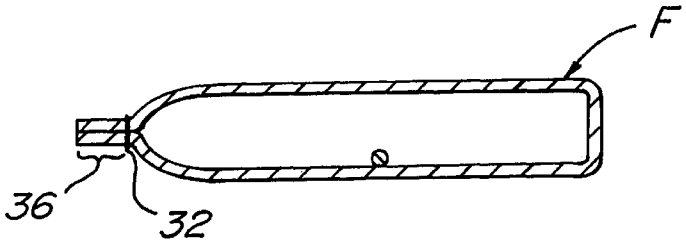
FIG. 5 is a transverse cross-sectional view taken on line 5—5 of FIG. 4.

20*f* facing inward, and sewing the strip along its longitudinal edge margins 20*a* & 20*b* forming a seam 32 and flange, or hem 36, with the lanyard 30 extending longitudinally inside the sewn and folded strip (referred to hereinafter as intermediate fabric tube F). One end 30*a* of the lanyard 30 is attached at the sewn seam 32 and the other end 30*b* extends beyond one end of the intermediate fabric tube F. At this stage, as can be seen in FIG. 5, the flange 36 produced by the seam 32 is oriented outwardly with respect to the fabric tube F.

Figure 6:
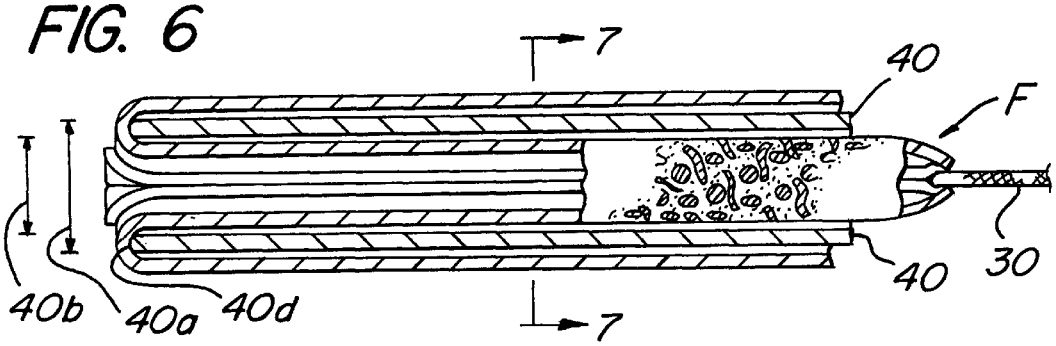
FIG. 6 is a fragmentary longitudinal cross sectional view of the fabric tube partially everted over a cylindrical everting tube.
Figure 7:
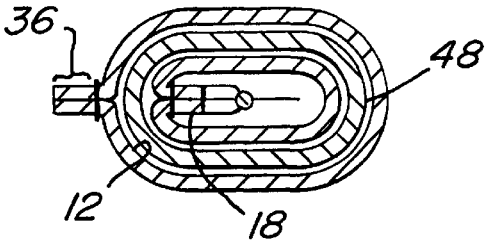
FIG. 7 is a transverse cross-sectional view taken on line 7—7 of FIG. 6.

The next step in the method involves everting the fabric tube F for concealing the flange 36. FIG. 6 is a fragmentary longitudinal cross-sectional view that evinces this method. The fabric tube F is everted by pulling the unattached end 30*b* of the lanyard through the tube F center, preferably by use of an everting cylinder 40 having an inner end 40*d*. The everting cylinder 40 is an elongate hollow body with an outer diameter 40*a* sufficiently small enough to be inserted into the fabric tube F and an inner diameter 40*b* sufficiently large enough to fit the lanyard 30 and fabric tube F. The everting cylinder 40 may have a longitudinal slot (not shown), so that after insertion into the fabric tube F, the lanyard 30 can be easily inserted laterally into the cylinder 40. The cylinder need not be as long as the cloth strip. It needs only be long enough to be gripped by one hand, while the lanyard 30 is being pulled with the end 40*d* engaged as shown. The fabric tube F is everted by placing the end 40*d* of the everting cylinder 40 inside the tube F, and pulling the lanyard 30 through the cylinder 40, to turn the outward flange 36 inward 18 as in FIG. 7 and turning the decorative out-side 12 outward.

Figure 8:
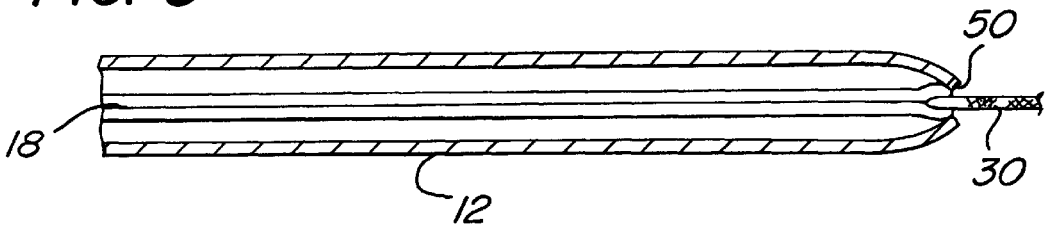
FIG. 8 is a fragmentary longitudinal cross-sectional view of the completely everted fabric tube before the outwardly-extending lanyard is severed.

The fabric tube F, after having been everted, is shown in longitudinal section in FIG. 8 with the flange 18 facing inward and its decorative out-side surface 12 facing outward. The lanyard 30 is subsequently severed from the fabric tube at 50 as by a shear and pulled lengthwise to remove it from inside the tube.

The fabric tube F is then slid lengthwise over a spring toy core 14 along its helical length with the seam 32 disposed alongside the inner edge of the helical body. Preferably, the fabric tube F is stretched slightly before being sewn transversely across its end margins 20*c* & 20*d* yielding a fabric-covered spring S as illustrated in FIG. 1. Finally, the fabric-covered spring S can be sewn to other fabric structures such as a plush imitation head and tail to provide an animal-like product having a semi-soft, flexible body.

In view of the foregoing, it should be apparent that the present invention now provides a fabric-covered spring toy having a decorative helical body and method for producing the same. It should also be apparent that the present invention provides a fabric covered spring toy with a concealed seam and a fabric-covered helical body that may be sewn to other fabric structures such as a plush animal body part for incorporation into a new product.

While a preferred embodiment of the present invention has been described in detail, various modifications, alterations, and changes may be made without departing from the spirit and scope of the present invention as defined in the appended claims.

What is claimed is:

1. A method of producing a fabric-covered spring toy having a helical body of a predetermined length, comprising the steps of:

providing an elongate strip of cloth having longitudinal edge margins and first and second end margins, said cloth having an in-side and an out-side;

folding the cloth strip lengthwise with the out-side facing inward;

sewing together the longitudinal edge margins for forming an elongate tube;

everting the tube so that the cloth out-side faces outward;

sliding the elongate tube over the helical body along its helical length; and sewing the tube at said end margins to enclose said helical body;

whereby a fabric-covered spring is produced.

2. A fabric covered spring toy made in accordance with the method of claim 1.

3. A method for producing a fabric-covered spring toy having a helical body of a predetermined length, comprising the steps of:

providing an elongate strip of cloth having longitudinal edge margins and first and second end margins, said cloth having an in-side and an out-side;

attaching a lanyard to said first end margin of said strip of cloth;

folding the cloth strip longitudinally over the lanyard with the out-side facing inward so that the lanyard extends inside the folded cloth from the first end margin to beyond the second end margin of the cloth strip;

sewing together the longitudinal edge margins for forming an elongate intermediate tube open at said end margins;

pulling the lanyard attached to the first end margin through the inside of the tube in order to evert the tube so that the cloth out-side faces outward;

severing said lanyard from said fabric tube and removing it from the fabric tube;

sliding the elongate tube over a spring toy along its helical length; and sewing the tube at said end margins to enclose said helical body;

whereby a fabric-covered spring is produced.

4. A fabric covered spring toy made in accordance with the method of claim 3.

5. A method for producing a fabric-covered spring toy having a helical body of a predetermined length, comprising the steps of:

providing an elongate strip of cloth of a stretchable material having longitudinal edge margins and first and second end margins, said cloth having a decorative side;

attaching a lanyard to said first end margin of said strip of cloth;

folding the cloth strip lengthwise over the lanyard with the cloth decorative side facing inward so that the lanyard extends inside the folded cloth from the first end margin to beyond the second end margin of the cloth strip;

sewing together the longitudinal edge margins for forming an intermediate elongate tube open at said end margins; inserting an everting cylinder inside the fabric tube;

pulling the lanyard attached to the first end margin through the inside of the tube in order to evert the tube so that the cloth decorative side faces outward;

severing said lanyard from said fabric tube and withdrawing it from inside the tube;

sliding the elongate tube over the helical body along its helical length;

stretching the fabric tube over the ends of the spring toy; and sewing the tube at said first and second end margins to fully enclose said helical body;

whereby a fabric-covered spring is produced.

6. A fabric covered spring toy made in accordance with the method of claim 5.

7. A method of producing a fabric-covered spring toy having a helical body of a predetermined length with coils having an outside edge, opposed confronting surfaces, and an inside edge, comprising the steps of:

providing an elongate strip of cloth having longitudinal edge margins and first and second end margins, said cloth having an in-side and an out-side;

folding the cloth strip longitudinally with the out-side facing inward;

sewing together the longitudinal edge margins for forming an elongate tube with an outward flange;

everting the tube so that the cloth out-side faces outward and the flange projects inward;

sliding the elongate tube with the flange disposed alongside said inside edge of said coil over the helical body along its helical length; and severing the lanyard and removing it from inside the intermediate tube;

sewing the tube at said end margins to enclose said helical body;

whereby a fabric-covered spring is produced.

8. A fabric covered spring toy produced in accordance with the method of claim 7 wherein the fabric provides a decoration covering both the inside edge, the outside edge, and the opposed confronting surfaces of the helical coils.

* * * * *